United States Patent [19]

Pomerantz et al.

[11] Patent Number: 4,516,458

[45] Date of Patent: May 14, 1985

[54] SLICING DEVICE FOR FOODSTUFFS

[76] Inventors: Julie Pomerantz; Paul Feeney, both of 230 Fifth Ave., New York, N.Y. 10001

[21] Appl. No.: 404,537

[22] Filed: Aug. 2, 1982

[51] Int. Cl.[3] ..... B26D 1/26; B26D 1/547

[52] U.S. Cl. ..... 83/651.1; 83/581.1; 83/609; 83/698; 30/116; 30/117

[58] Field of Search ..... 83/651.1, 581.1, 609, 83/698; 30/116, 117

[56] References Cited

U.S. PATENT DOCUMENTS 1,540,246 6/1925 Blassie ..... 30/117

3,766,817 10/1973 Aby et al. ..... 83/651.1

FOREIGN PATENT DOCUMENTS 1034341 4/1953 France ..... 30/116

*Primary Examiner*—Donald R. Schran

[57] ABSTRACT

A slicing apparatus for foodstuffs comprising a baseboard with a groove extending transversely thereof; a bore extending into one end of the baseboard through and beyond the groove; a U-shaped bar having two legs and a central portion; the first leg of the U-shaped bar extending into the bore beyond the groove and having a slot located immediately below the groove; said leg being frictionally engaged in the bore to prevent lateral movement in said bore but being rotatable in the bore; the second leg of the U-shaped bar having a transverse hole, a handle with a spindle carried within the hole in the second leg of the U-shaped bar and an adjusting nut carried on the spindle having a transverse slot; a cutting element with enlarged end portions carried within the slots on the leg of the U-shaped bar and the adjusting nut so that when tightened the cutting element may be utilized to provide a slicing apparatus for foodstuffs, and including a passage in the baseboard near the juncture in the baseboard of the bore and the groove. The passage is adapted to receive a cutting element end for engaging the slot in the first leg when assembling the cutting element in position.

9 Claims, 5 Drawing Figures

SLICING DEVICE FOR FOODSTUFFS

BACKGROUND OF THE INVENTION

This invention relates to a slicing apparatus for slicing relatively firm foodstuffs such as cheese and the like.

There are various proposals in the prior art for such cutting devices. Among them are provisions for wire strand cutters secured to holders whereby vertical movement of the holder will cause the wire strand to pass through and slice portions of cheese blocks and the like. One such proposal is found in U.S. Pat. No. 1,796,212 in which a wire strand is attached between the legs of a U-shaped holder. One end of the U-shaped holder is secured to a baseboard provided with a groove located under the wire strand. When the holder is pivoted downwardly, the wire strand passes through the foodstuff and then into the groove in the baseboard and a slice is cut thereby. Another suggestion is found in U.S. Pat. No. 2,037,856 which utilizes wire strands held taut by means of a rotary wheel for passage through the item to be sliced. U.S. Pat. No. 3,766,817 discloses a cutting device which has a base for supporting the foodstuff to be cut. A U-shaped bar is arranged transversely of the base in such fashion that when the bar is pivoted downwardly about a vertical plane, the wire strand is moved through the foodstuff ultimately into a slot existing transversely of the base. In this patent the one end of the wire strand is attached to a pivotable lever which is moveable to positions which are approximately at right angles to each other. One leg of the U-shaped bar is secured to this lever and the other leg is loosely accommodated within a passageway in the base which traverses the slot. The other end of the wire strand passes through the slot and passageway in the base and is looped around the leg of the U-shaped bar which is in the passageway. Thus, the U-shaped bar is prevented from moving out of the passageway by its engagement with the looped wire.

When the lever is moved to a position at right angles to the base, the wire strand is slack and the end of the U-shaped bar in the passageway may be removed therefrom for removal and replacement of the wire. When the end of the wire is looped around the leg of the U-shaped bar in the passageway, movement of the lever to a position substantially parallel with the base places the wire strand under tension and it may then be used for cutting purposes.

While the aforesaid arrangement does satisfactorily cut foodstuff when the wire is taut, there are certain problems presented. In the first instance, a certain amount of difficulty may be encountered in looping the wire strand around the leg of the U-shaped bar extending through the passageway because the slot in the base is necessarily quite narrow and looping the wire around the leg of the bar must be made blindly. Furthermore, if the loop is not relatively taut around the leg of the bar which is loose in the passageway it may be possible to move the bar relative to the slot and thereby interfere with the effectiveness of the slicing operation. In addition, because of the loop and lever arrangements, the length of the wire must be predetermined within relatively strict tolerances in order to move from a slack position to a taut position upon pivotal movement of the lever.

The present invention overcomes the foregoing problems while nevertheless providing a slicing structure which is effective and easy to assembly. In addition, the replacement of the slicing wire strand may be effected in a simple and expeditious manner with the structure parts being maintained in a fixed position devoid of any possibility of slippage with relation to each other.

SUMMARY OF THE INVENTION

The present invention provides a food slicer which is positive in operation and whose parts are locked in functional co-relation with minimum possibility of inadvertent displacement.

The invention provides a relatively flat baseboard having a groove extending transversely thereover. A relatively conventional U-shaped bar is provided and one leg of said bar is accommodated in a bore extending into an end of the base through the aforementioned groove and beyond toward the other end of the base. The portion of the leg of the U-shaped bar extending beyond the groove is secured in the bore by frictional engagement or any other suitable means of securement. The engagement is such that the leg of the bar may rotate within the bore. However, the leg is frictionally engaged within the inner extremity of the bore to inhibit lateral movement of the leg in the bore.

A slot extends transversely of the leg of the bar and is located therein directly below the groove in the base through which the bar extends. The other leg of the U-shaped bar has a transverse hole. A handle is provided with a threaded spindle which is inserted through the hole in the leg of the U-shaped bar for fastening the handle to this leg. A spacer nut is threaded onto the end of the spindle extending through the hole opposite the handle portion. An adjusting nut provided with a transverse slot is threaded to the spindle adjacent to and spaced from the spacer nut.

A wire strand having an enlarged bead at each end is placed in position between the two legs of the U-shaped bar. One end of the wire strand is positioned in the slot in the leg of the bar extending into the bore in the baseboard. The bead on this end of the wire is disposed in a recess at the outer extremity of the slot to maintain the wire strand in position within the slot. The other end of the wire strand is positioned within the slot in the adjusting nut located adjacent the handle. The bead on this end of the wire strand is disposed on the extremity of this slot in the nut to maintain the wire strand in position within the slot.

Novel means are provided which facilitate the replacement of the wire strand when necessary without in any way disturbing the frictional engagement of the leg of the U-shaped bar and the bore in which the leg extends. These means include a passageway extending from the top to the bottom of the baseboard, and thus completely therethrough, at a point near and communicating with the juncture of the groove and the bore in the baseboard.

When the handle and its spindle are rotated in one direction the adjusting nut will be laterally moved along the threads in a direction toward the handle and the wire strand will become taut, and when the handle and its spindle are rotated in the other direction the adjusting nut will be laterally moved along the threads in a direction away from the handle and the wire strand will become loose. Thus the strand may be easily removed, replaced and tightened.

When the strand is taut it is carried between the recess in the slot in the leg of the U-shaped bar and the slot in the nut. The strand is prevented from displacement by the frictional engagement of the beads at both ends of the wire and the outer portion of the slots in the leg and nut. In this position the taut wire is located directly over and in alignment with the groove in the base. The wire strand does not function in any way to prevent lateral movement of the leg of the bar in the bore. This leg is frictionally held within the bore but is sufficiently free to permit pivoting or rotating movements.

With this structure and with the wire strand taut foodstuffs placed on the baseboard may be sliced by simply moving the handle and thereby the U-shaped bar carrying the wire strand through the foodstuff to be sliced and into the groove in the baseboard.

The invention is described in more detail in the following specification in conjunction with the accompanying drawings.

DETAILED DESCRIPTION OF THE INVENTION

Figure 1:
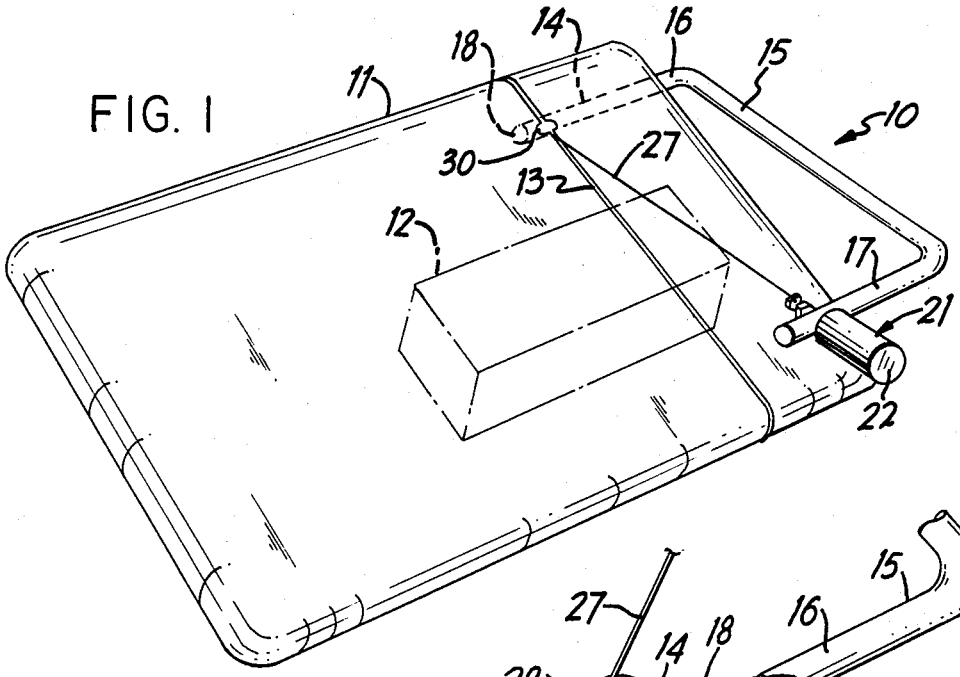
FIG. 1 is a perspective view of the food slicing structure of the present invention with the wire strand in cutting position above the baseboard and showing in dotted lines the bore in the baseboard.
Figure 2:
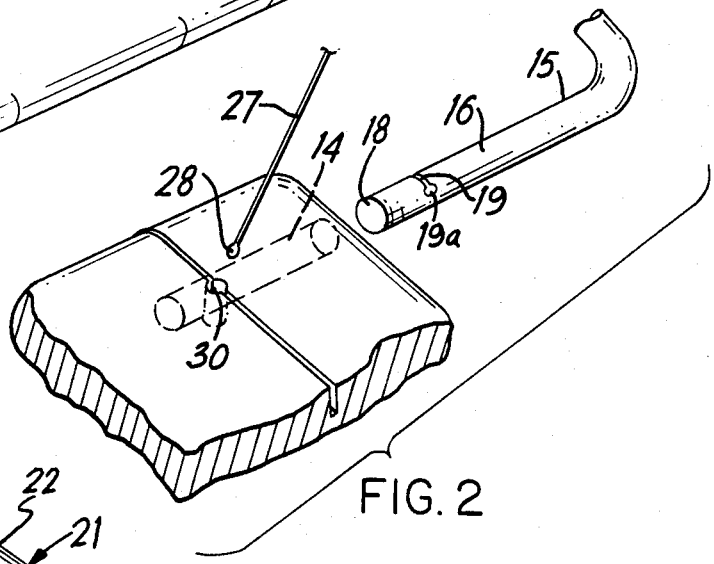
FIG. 2 is a perspective exploded view of the leg of the U-shaped slotted bar which extends into the bore and the wire strand with the beaded portion in position to be placed in the recess at one extremity of the slot.
Figure 3:
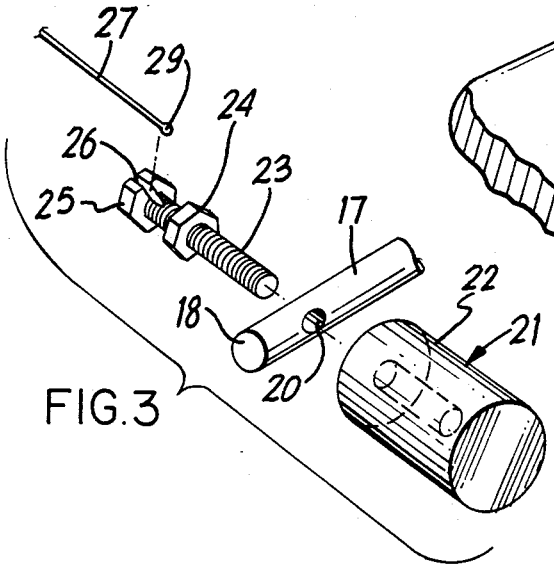
FIG. 3 is a perspective exploded view of the handle portion of the slicing structure showing the handle and its spindle passing through the hole in the other leg of the U-shaped bar together with the spacer nut and the slotting holding nut and the wire strand with the beaded portion in position to be placed through the slot in the nut.
Figure 4:
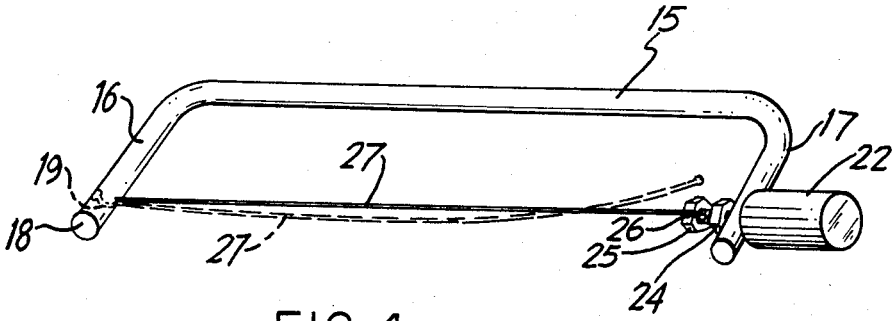
FIG. 4 is a perspective view showing the U-shaped bar without the baseboard to illustrate the wire strand carried between the legs of the U-shaped bar in taut position and, in dotted lines, in unstressed position.

As shown in the drawings and the present invention involves a slicing apparatus 10 comprising a baseboard 11 made of wood or any other suitable material for supporting foodstuff 12 to be sliced such as blocks of cheese or the like. The baseboard 11 is provided with a recessed groove 13. The baseboard is also provided with a bore 14 extending into the board from one end thereof and traversing and extending beyond the groove 13, and such that the bore 14 communicates with the groove 13 at a juncture inherently formed therebetween, for the purposes hereinafter set forth.

A U-shaped bar 15, preferably of metal, is located over the baseboard and one leg thereof is secured within the bore 14 of the baseboard while being movable in a pivoting fashion relative to the baseboard. The U-shaped bar 15 has legs 16 and 17. The leg 16 extends into the bore 14 to a point beyond the groove 13. The end 18 of the leg 16 extending into the bore beyond the groove 13 is frictionally engaged within the inner extremity of the bore in such fashion that it is inhibited from lateral movement in the bore or removal from the bore. This arrangement permits pivotal or rotary movement of the leg 16 in the bore while inhibiting lateral movement of the bar out of the bore 14. The leg 16 of the U-shaped bar 15 is provided with a slot 19 at a point located directly below the groove 13, i.e., such that the slot 19 is disposed in the bore 14 immediately below the groove 13 and in a lateral position inherently in alignment with the groove 13, and has a recess **19*a* at one extremity of the slot 19** for the purposes hereinafter set forth.

The other leg 17 of the U-shaped bar 15 has a hole 20 extending therethrough near its extremity, i.e., in a corresponding lateral position in alignment with the groove 13. A handle 21 having an enlarged gripping portion 22 and a threaded rotary spindle 23 is secured to the leg 17 of the U-shaped bar 15. This engagement is accomplished by inserting the spindle 23 through the hole 20 and threading a spacer nut 24 thereon. An adjusting nut 25 is threaded on to the spindle adjacent to, but spaced from, the spacer nut 24. The adjusting nut 25 is provided with a transverse slot 26 which when the slicing device is assembled is aligned with the slot 19 on the leg 16, i.e., the slot 26 is disposed in a corresponding lateral position in alignment with the groove 13 and with the slot 19 of leg 16. A strand of wire 27 having beads 28 and 29 at each end extends directly over the groove 13 in the baseboard 11 between the leg 16 and the slotted nut 25.

One end of the wire 27 is disposed in the slot 19 in the leg 16 of the U-shaped bar 15 with the bead 28 being located in the recess **19*a* at the outer extremity of the slot. The other end of the wire 27 is accommodated within the slot 26 in the nut 25 with the bead 29 disposed at the outer extremity of the slot 26 in this nut. When the wire is located between the slots in the leg 16 and the nut 26, the wire is in a corresponding lateral position in alignment with the groove 13, and the handle 21 and its spindle 23 may be rotated while holding the nut 25** in position. This will cause the wire to become taut for slicing operations.

Thus, the end position of the leg 16 extending into the bore 14 is frictionally engaged in the bore to prevent lateral movement of the leg 16 in the bore and in turn to prevent lateral movement of the slot 19 from its lateral position in alignment with the groove 13, yet the end portion of the leg 16 may be rotated in the bore 14.

In operation the handle 21 is gripped and moved upwardly around the pivoting leg 16 carrying the wire strand 27 with it. When the handle 21 is moved downwardly around the pivoting leg 16, the taut wire slices through the foodstuff in an efficient and simple manner. The wire passes beyond the foodstuff into the groove 13 to insure that a complete slice is made.

In the event the wire breaks or it becomes desirable to remove it for some other reason, all that is required is to rotate the handle 21 and its spindle 23 in a direction opposite to the direction of tightening whereupon the nut 25, when restrained from rotational movement, will become spaced from the handle 21 causing the wire strand 27 to become slack. The wire may then be removed from the slots 19 and 26 without difficulty.

Figure 5:
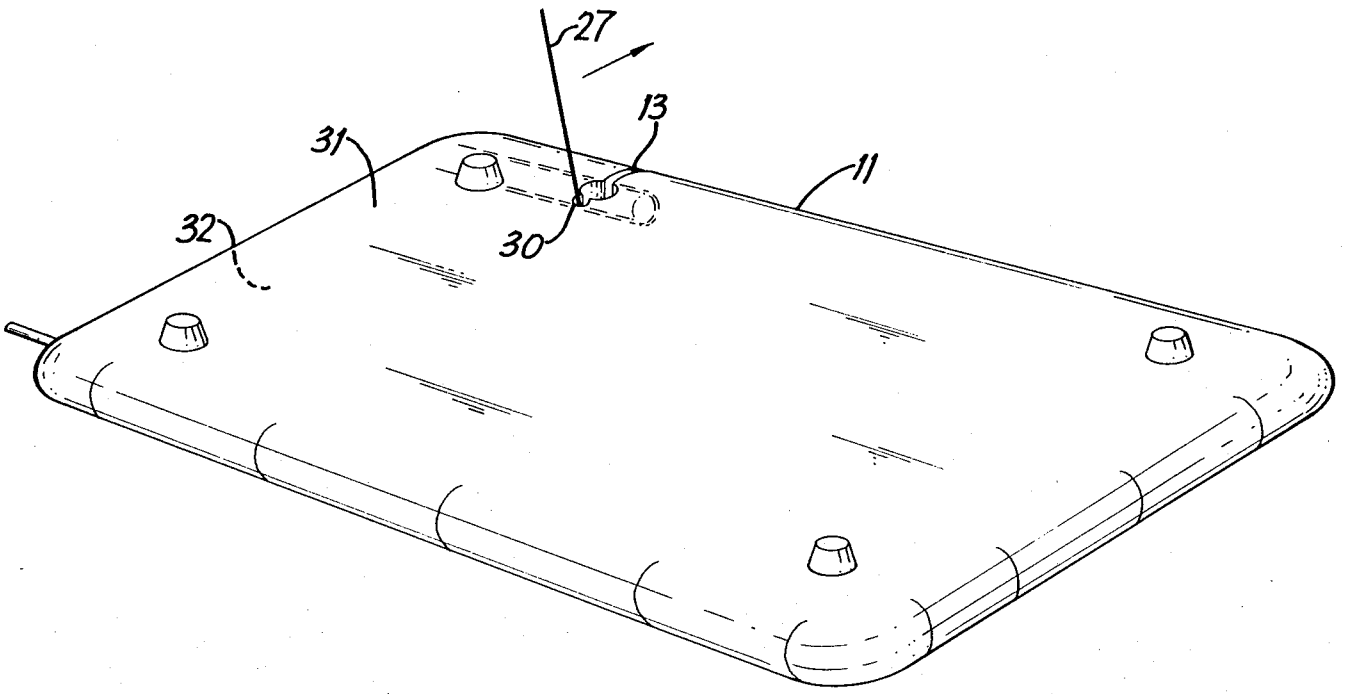
FIG. 5 is a perspective view of the food slicing structure of the present invention showing the wire strand in position to engage the recess at one extremity of the slot in the leg of the U-shaped bar, showing in dotted lines the engagement which occurs after the beaded end of the wire is moved into said recess.

In accordance with the present invention as shown in FIGS. 1 and 5 a new and novel arrangement permits replacement of the wire strand 27 when necessary without in any way affecting the extremely desirable frictional engagement between the extremity of the leg 16 and the bore 14 in the baseboard 11. Such means comprise a passage 30 extending completely through the baseboard at a point preferably near and communicating with the junction between the groove 13 and the bore 14.

To replace the wire the baseboard is turned over so that its underside 31 faces upwardly as shown in FIG. 5. The wire strand 27 is dropped into the passage 30 with only a small portion of the beaded end of the strand extending above the upper surface 32 of the baseboard. The wire strand 27 is then moved in the direction of the arrow toward the leg 16. While this is done the U-shaped bar is extended from the baseboard to the position shown in FIG. 5. In this position the recess 19*a* is adjacent the bead 28 at one end of the wire strand 27. When the bead 19*a* is inserted in the recess the other end of the wire must be fastened in the slot 26 of the nut 25 near the handle 21. The baseboard is returned to its normal position with the upper surface 32 at the top and the U-shaped bar is positioned so that the wire strand will be carried in the slot 19 in the leg 16. The wire strand is then made taut in the manner described above.

Thus, there is provided a very simple and efficient device in which the wire functions only to cut or slice the foodstuff being maintained in position in a simple fashion and having no function to maintain the leg 16 of the U-shaped bar 15 in the bore 14 in the baseboard 11. The movement to make the wire taut or slack is accomplished simply and replacement of the wire is made expeditiously without any blind gripping for the insertion of a new replacement wire.

While the invention has been described in some detail, it will be understood that some variations and modifications may be made without departing from the spirit of the invention as defined in the appended claims.

What is claimed is:

1. Slicing apparatus for relatively firm foodstuffs comprising:

a baseboard having a groove extending transversely thereof;

a bore extending into one end of said baseboard through and beyond said groove toward the other end of said baseboard and such that such bore communicates with said groove at a juncture formed therebetween;

a U-shaped bar having a first leg, a second leg and a central portion;

the end portion of the first leg of said U-shaped bar extending into said bore beyond said groove and being provided with a slot disposed in said bore immediately below said groove and in a lateral position in alignment with said groove;

said end portion of said first leg being frictionally engaged in said bore to prevent lateral movement of said first leg in said bore and in turn to prevent lateral movement of said slot in said first leg from its lateral position in alignment with said groove, and said end portion of said first leg also being rotatable in said bore;

a passage exiting through the baseboard substantially adjacent the junction between the slot and the bore to accommodate the cutting element when replaced; and a handle carried by the second leg of the U-shaped bar.

2. Apparatus of claim 1 including:

the second leg of said U-shaped bar being provided with a transverse hole in a lateral position substantially in alignment with said groove;

a handle having a rotary spindle carried within said hole in said second leg of said U-shaped bar;

an adjusting nut carried on said spindle and provided with a transverse slot in a corresponding lateral position in alignment with said groove and with said slot in said first leg; and a cutting element having enlarged end portions carried within the slots in the leg of the U-shaped bar and the adjusting nut.

3. Slicing apparatus for relatively firm foodstuffs comprising:

a baseboard having a groove extending transversely thereof;

a bore extending into one end of said baseboard through and beyond said groove toward the other end of said baseboard and such that such bore communicates with said groove at a juncture formed therebetween;

a U-shaped bar having a first leg, a second leg and a central portion;

the end portion of the first leg of said U-shaped bar extending into said bore beyond said groove and being provided with a slot disposed in said bore immediately below said groove and in a lateral position in alignment with said groove;

said end portion of said first leg being frictionally engaged in said bore to prevent lateral movement of said first leg in said bore and in turn to prevent lateral movement of said slot in said first leg from its lateral position in alignment with said groove, and said end portion of said first leg also being rotatable in said bore;

the second leg of said U-shaped bar being provided with a transverse hole in a lateral position substantially in alignment with said groove;

a handle having a rotary spindle carried within said hole in said second leg of said U-shaped bar;

an adjusting nut carried on said spindle and provided with a transverse slot in a corresponding lateral position in alignment with said groove and with said slot in said first leg;

a cutting element having enlarged end portions carried within the slots in the leg of the U-shaped bar and the adjusting nut;

said enlarged portions of the cutting element being disposed at the outer extremities of said slots and said cutting element being in a corresponding lateral position in alignment with said groove, whereby upon rotary movement of the spindle the movement of the adjusting nut thereover causes the cutting element to be tightened or loosened; and said first leg in said bore providing a pivot, whereby upon pivotal downward movement of the U-shaped bar the cutting element carried between the first and second legs slices foodstuffs resting on said baseboard.

4. Apparatus of claim 3 including a passage in said baseboard near and communicating with the juncture in the baseboard of said bore and said groove, said passage receiving said cutting element for engagement with the slot in said first leg at the juncture when assembling said cutting element in position.

5. Apparatus of claim 4 including a recess at one extremity of said slot in said first leg of the U-shaped bar for engaging and maintaining the enlarged portion of said cutting element thereat.

6. Apparatus of claim 5 in which the cutting element is a wire strand.

7. Apparatus of claim 5 in which the second leg of the U-shaped bar is operatively disposed between said handle and said adjusting nut.

8. Apparatus of claim 5 in which the spindle on said handle is threaded.

9. Apparatus of claim 5 in which a spacer means is operatively carried by the spindle between the adjusting nut and the second leg of said U-shaped bar.

* * * * *